US005960559A

United States Patent [19]

Brunnmair et al.

[11] Patent Number: 5,960,559

[45] Date of Patent: Oct. 5, 1999

[54] PROCESS AND APPARATUS FOR DRYING MATERIAL

[75] Inventors: Erwin Brunnmair; Reinhard Pinter, both of Graz, Austria

[73] Assignee: Andritz-Patentverwaltungs-Gesellscaft m.b.h., Graz, Austria

[21] Appl. No.: 08/843,304

[22] Filed: Apr. 14, 1997

[30] Foreign Application Priority Data

Apr. 17, 1996 [AT] Austria ..... 694/96

[51] Int. Cl.[6] ..... F26B 3/00

[52] U.S. Cl. ..... 34/514; 34/371; 34/424; 34/79; 34/85; 34/86; 110/216; 110/245; 432/72; 432/59

[58] Field of Search ..... 34/85, 86, 476, 34/479, 513, 79, 359, 360, 363, 364, 370, 373, 379, 423, 467, 477, 487, 514; 110/216, 245; 432/72, 59

[56] References Cited

U.S. PATENT DOCUMENTS

| | | | |
|---|---|---|---|
| 3,909,410 | 9/1975 | Neukamm | 34/347 |
| 3,958,920 | 5/1976 | Anderson | 432/23 |
| 4,145,278 | 3/1979 | Davy | 210/711 |
| 4,193,206 | 3/1980 | Maffet | 34/385 |
| 4,696,115 | 9/1987 | Spadafora | 34/43 |
| 4,713,893 | 12/1987 | Webb | 34/25 |
| 4,984,374 | 1/1991 | Bird et al. | 34/50 |
| 5,037,561 | 8/1991 | Copeland | 210/769 |
| 5,067,254 | 11/1991 | Linkletter et al. | 34/137 |
| 5,069,801 | 12/1991 | Girovich | 210/770 |
| 5,223,088 | 6/1993 | Hansen | 159/2.1 |
| 5,259,977 | 11/1993 | Girovich et al. | 210/770 |
| 5,309,849 | 5/1994 | Krebs | 110/224 |
| 5,318,184 | 6/1994 | Krebs | 209/21 |
| 5,474,686 | 12/1995 | Barr | 210/771 |
| 5,588,222 | 12/1996 | Thompson | 34/379 |
| 5,775,004 | 7/1998 | Steier | 34/424 |

*Primary Examiner*—Henry Bennett
*Assistant Examiner*—Pamela A. Wilson
*Attorney, Agent, or Firm*—Roylance, Abrams, Berdo & Goodman, L.L.P.

[57] ABSTRACT

A process and apparatus for drying material, in which a previous dried material is mixed into the wet material to be dried to produce a dried mixture of different particle sizes. The process for drying material requires less industrial equipment implemented in a more economical and simpler plant that can be operated with low energy and maintenance requirments. The amount of fine material obtained after drying is measured and the amount of fine previously dried material mixed into the wet material to be dried is then set in inverse proportion to the quantity of fine dried material produce.

34 Claims, 3 Drawing Sheets

PROCESS AND APPARATUS FOR DRYING MATERIAL

FIELD OF THE INVENTION

The present invention relates to a process for drying material and, in particular, sewage sludge. More particularly, the invention is directed to a drying process where a granulate of fine particle size material that has been previously dried is mixed into the fresh material still to be dried.

BACKGROUND OF THE INVENTION

In drier loops, for example, in plants for sludge drying, granulate with different grain sizes is produced from the material being dried. The size of the dried grains depends on the operating status of the plant in each case and on the nature of the material being dried, including, for example, the composition, moisture content and the condition of the sludge. These different grain sizes are usually divided into separate fractions using a filter screen, A roller mill is used to crush the large and some of the medium fraction of the dried particles in order to provide the desired amount of fine material required for back-feeding to the incoming fresh material to be dried. The dried fraction is often mixed with fresh wet material to increase the volume of the material and reduce the ratio of the water to solids. The roller mill, however, has the disadvantage of high investment costs and high energy consumption. In addition, it is subject to a great deal of wear and, as a consequence, requires extensive servicing, thus generating high maintenance costs.

Accordingly, there is a continuing need in the industry for a drying process that is more efficient.

SUMMARY OF THE INVENTION

The present invention is directed to a process and apparatus for drying wet material and, in particular, sewage sludge. A primary object of the invention is to provide a process and apparatus for drying wet material which monitors and measures the amount of dried material produced having a predetermined particle size and controls the drying of the wet material in relation to the amount of the predetermined particle size of dried material produced.

A further object of the invention is to provide a process and apparatus for drying material which requires less industrial equipment and which can be implemented in a more economical and simplified plant and which is operated with lower energy and maintenance requirements.

Another object of the invention is to provide a process and apparatus for drying wet material which produces a dried material having different particle sizes, separates and recycles the smaller particle size of the dried material to the feed for mixing with fresh wet material to be fed to a drier.

A further object of the invention is to provide a process and apparatus for producing dried material of large and small particle sizes and controlling the feed rate of material through a drier in response to the amount of the small particle size fraction obtained from the drier.

Another object of the invention is to provide a process and apparatus for drying a mixture of wet and previously dried material to produce a dried material of large and small particle sizes and having a control device for controlling the ratio of the wet material and previously dried material fed to a drier in response to the amount of small particle size material produced from the drier.

The process and apparatus of the invention forms a mixture of wet material and a previously dried material of small particle size which passes through a drier and produces a dried material mixture having large and small particles. The quantity of small particles obtained from the drier is measured and the amount of the previously dried material mixed with the fresh wet material is adjusted inversely proportional to the amount of small particle size material produced. In this manner, as the amount of small particle size material obtained from the drier is reduced, the amount of small particle size material mixed with the wet material is increased. This produces an increase in the amount of small particle size material obtained from the drier.

Another object of the invention is to recycle the small particle size fraction of the dried material obtained from the drying step to a mixing device for mixing with the fresh wet material as the only previously dried material added to the wet material. This eliminates the need to crush or grind large particles obtained from the drying step before mixing with the wet material.

A further object of the invention is to measure the amount of small or fine particles obtained from the drier at predetermined time intervals and adjusting the amount of previously dried material mixed with the wet material at the same time intervals.

Another object of the invention is to continuously measure the amount of fine particle size material obtained from the drier and to continuously adjust the amount of previously dried fine particle size material mixed with the wet material in response to the measured amount of fine particle size material.

A further object of the invention is to measure the exit temperature from the drier and to adjust the amount of previously dried material added to the fresh wet material in response to the drier exit temperature.

The objects of the invention are basically attained by providing a continuous process for drying a solid-liquid mixture comprising the steps of: forming a mixture of a wet material and a previously dried granular material having a predetermined particle size; passing the mixture through a drying device to produce a dried product containing a first granular fraction of the granular material, and a second fraction having a particle size greater than the first fraction; transferring the first fraction to a storage device and measuring the volume of the first fraction in the storage device produced in the drying step; and adjusting the amount of the previously dried material mixed with the wet material in relation to the volume of the first fraction obtained from the drying step to produce a predetermined quantity of the first fraction in the drying step.

The objects of the invention are further attained by providing a process of drying a wet material comprising the steps of: continuously feeding a wet material to a mixer at a first rate; continuously feeding a previously dried material having a first particle size to the mixer at a second rate and mixing with the wet material to form a mixture; drying the mixture in a drier to produce a dried material containing a mixture of the first particle size material and a dried material having a second particle size larger than the first particle size; separating the material of the first particle size from the dried mixture and conveying the material of first particle size to a storage device, and measuring the amount of the material in the storage device; recycling the material of first particle size in the storage device to the mixer for mixing with the wet material; and adjusting the second feed rate of the previously dried material to the mixer in response to the measured amount of dried material in the storage device.

The objects of the invention are also attained by providing a drying apparatus for drying a wet material comprising a mixer for mixing a wet material and previously dried material; a first feeder for feeding a wet material to the mixer at a first feed rate; a second feeder for feeding a dried material of a first particle size to the mixer at a second feed rate; a drier for drying the mixture of wet and previously dried material to produce a mixture of dried material of the first particle size and a dried material having a second particle size greater than the first particle size; a storage device for receiving the dried material of the first particle size, the storage device including a level sensing device for measuring the level of material therein; a conveyor for conveying the dried material of the first particle size in the storage device to the second feeder; and a control device operatively connected to the first and second feeders and to the level sensing device for adjusting the second feed rate of the second feeder in response to a level of dried material in the storage device.

These and other objects, advantages and salient features of the invention will become apparent from the following detailed description, which taken in conjunction with the drawings, discloses preferred embodiments of the invention.

BRIEF DESCRIPTION OF THE DRAWINGS

Referring to the drawings which form a part of this disclosure.

DETAILED DESCRIPTION OF THE INVENTION

The present invention is directed to a process and apparatus for drying a wet material in the form of a solid-liquid mixture, such as, for example, sewer sludge, in a drying plant. The wet material to be dried is mixed with a previously dried material to produce a mixture which is more easily handled and less sticky than the fresh dried material. The resulting mixture which has a higher solids to water ratio than the fresh wet material is then passed through a drier which produces dried particles of different sizes. The smaller sized particles are recovered and recycled for mixing with fresh wet material to be passed through the drier. The larger particles produced are discarded.

Figure 1:
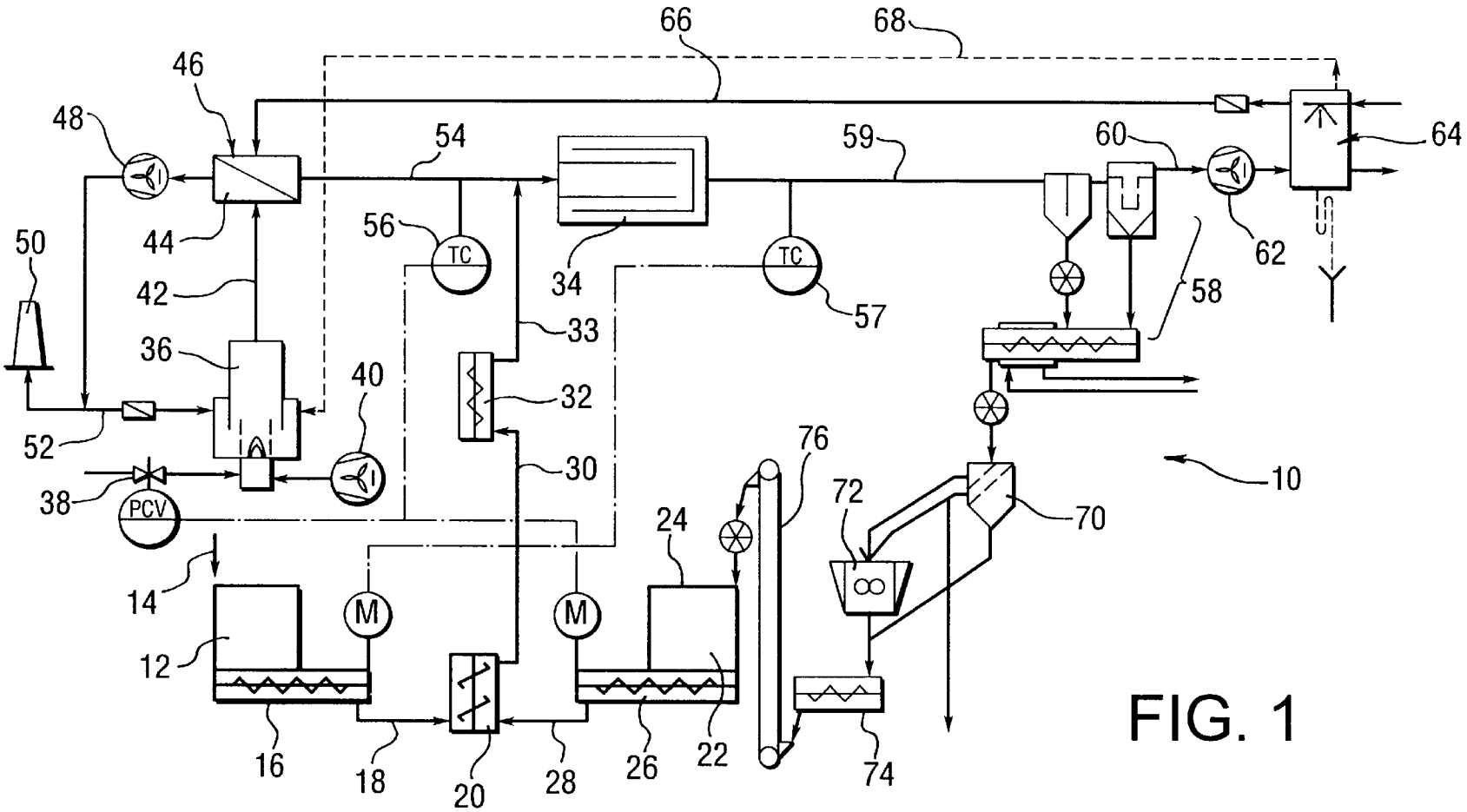
FIG. 1 shows a schematic diagram of a conventional prior art sludge drying plant.

A conventional drying process of a drying plant is illustrated schematically in FIG. 1. Referring to the drying assembly 10 of FIG. 1, a first silo 12 receives the wet material 14 to be dried and serves as a supply buffer for storing the wet material. The wet material is conveyed by a screw feeder 16 through a line 18 to a mixer 20. Simultaneously, a previously dried material 22 of a fine or small particle size is stored in a second silo 24 and is conveyed to the mixer 20 by a screw feeder 26 through a similar line 28 where the wet material and the previously dried, fine grain material are mixed. The amount of previously dried material mixed with the fresh wet material is selected to obtain a desired moisture content and to improve handling properties of the material. The resulting mixture of wet material and previously dried material passes through a line 30 to a screw conveyor 32 and through line 33 to a drier 34, such as, for example, a drum drier, for drying the mixture.

In the apparatus illustrated, an oil or gas fired furnace 36 has a fuel source operated by a valve 38 and an air source operated by a suitable fan or blower 40. The furnace 36 produces hot exhaust gases which are carried through a line 42 to the primary side 44 of a heat exchanger 46. The hot gases in the heat exchanger 46 are carried by a fan 48 to an exhaust chimney 50 or returned through a separate line 52 to the furnace to be reheated. The heat exchanger heats the drying gas or air which is conveyed to the drier 34 by a suitable line 54. A temperature sensor 56 measures the temperature of the air fed to drier 34. The temperature sensor 56 is connected to valve 52 for controlling the fuel feed rate to the furnace 36 and to screw feeder 26 for controlling the feed rate of dried material in relation to the temperature of the drying air in line 54.

The mixture of wet material and previously dried material in line 30 passes through the drier 34 and along line 59 to a suitable filter assembly 58 for separating the drying air from the dried solid materials. A temperature sensor 57 measures the output temperature from the drier 34 and controls the feed rate of the screw feeder 16. The drying air extracted from the dried solid materials passes along line 60 by a fan 62 through a condenser 64 for removing moisture and other liquifiable vapors and is then returned to the heat exchanger through a pipe 66. Excess air from the condenser 64 which in many plants can be approximately 100 to 300 cubic meters per hour per ton of water evaporation is returned to the furnace 36 through a pipe 68 for reheating and passing through the heat exchanger 46.

The solid dried constituents from the drier 34 are separated from the air in the filter plant 58. The filter plant 58 for separating the drying gas from the dried material can be any conventional structure as known in the art. The dried constituents from the filter plant 58 typically pass through a filter screen 70 to separate large granules and a portion of medium sized granules which are then conveyed to a crushing device 72. The crushing device 72 is typically a roller mill which reduces all of the dried particles to a predetermined particle size range. A portion of the crushed particles is conveyed by a screw feeder 74 and conveyer 76 to the second silo 24 for mixing with the wet material. A portion of the large and medium size granules are packed and loaded and discarded in a suitable manner. The oversized particles can be further processed or stored for later use as needed. The small particle size fraction which passes through the screen 70 is delivered to the screw feeder 74 for conveying to the second silo 24.

Figure 2:
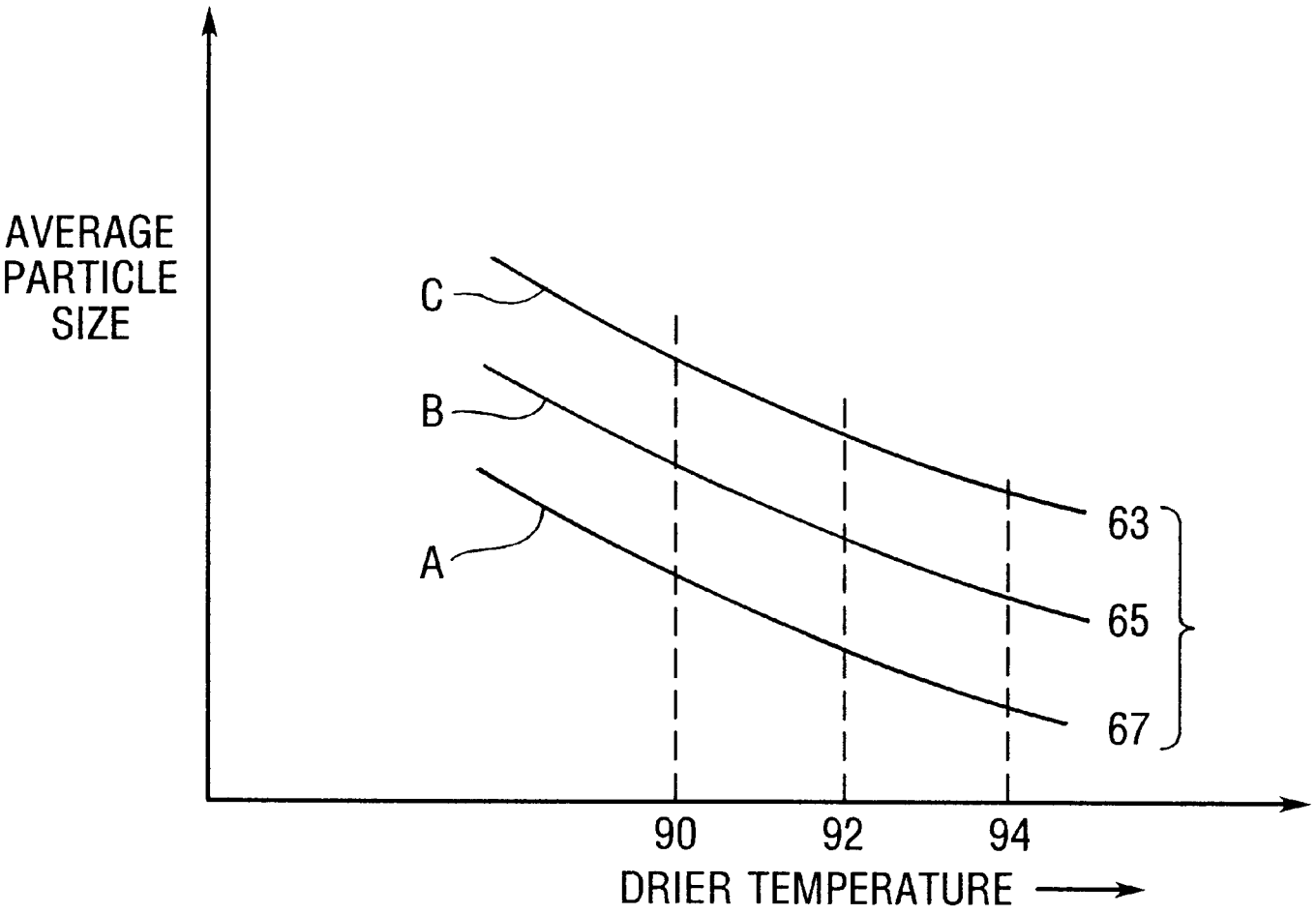
FIG. 2 is a graph illustrating the average particle size obtained from a drier in relation to the degree of dryness of the dried material.

FIG. 2 is a graph illustrating the relationship between the oversize particle size of the dried material exiting a drier in relation to the drying or drier temperature and the degree of dryness of the material entering the drier as indicated by lines A, B and C. As shown in the graph, the average particle size of the material exiting the drier becomes smaller as the drier temperature and degree of dryness in the final product increases. Thus, the proportion or fraction of fine or small particles in the resulting dried material increases with the final degree of dryness of the dried material. This correlation is generally applicable to all forms of drying materials, particularly drying sewer sludge, regardless of whether the drying is carried out in a drum drier, fluidized bed or disc drier. As shown, a higher rate of back feeding or recycling of small particle size previously dried material as indicated by line A having 67% solids in the starting material produces a drier initial mixture entering the drier which results in a dried product having a higher proportion of small or fine particle size compared to a mixture having a smaller proportion of previously dried material mixed with fresh wet material as indicated by lines B and C having 65% and 63% solids which produce a smaller proportion of the small particle size fraction. These figures are examples of data usually obtained in sewer sludge driers.

Figure 3:
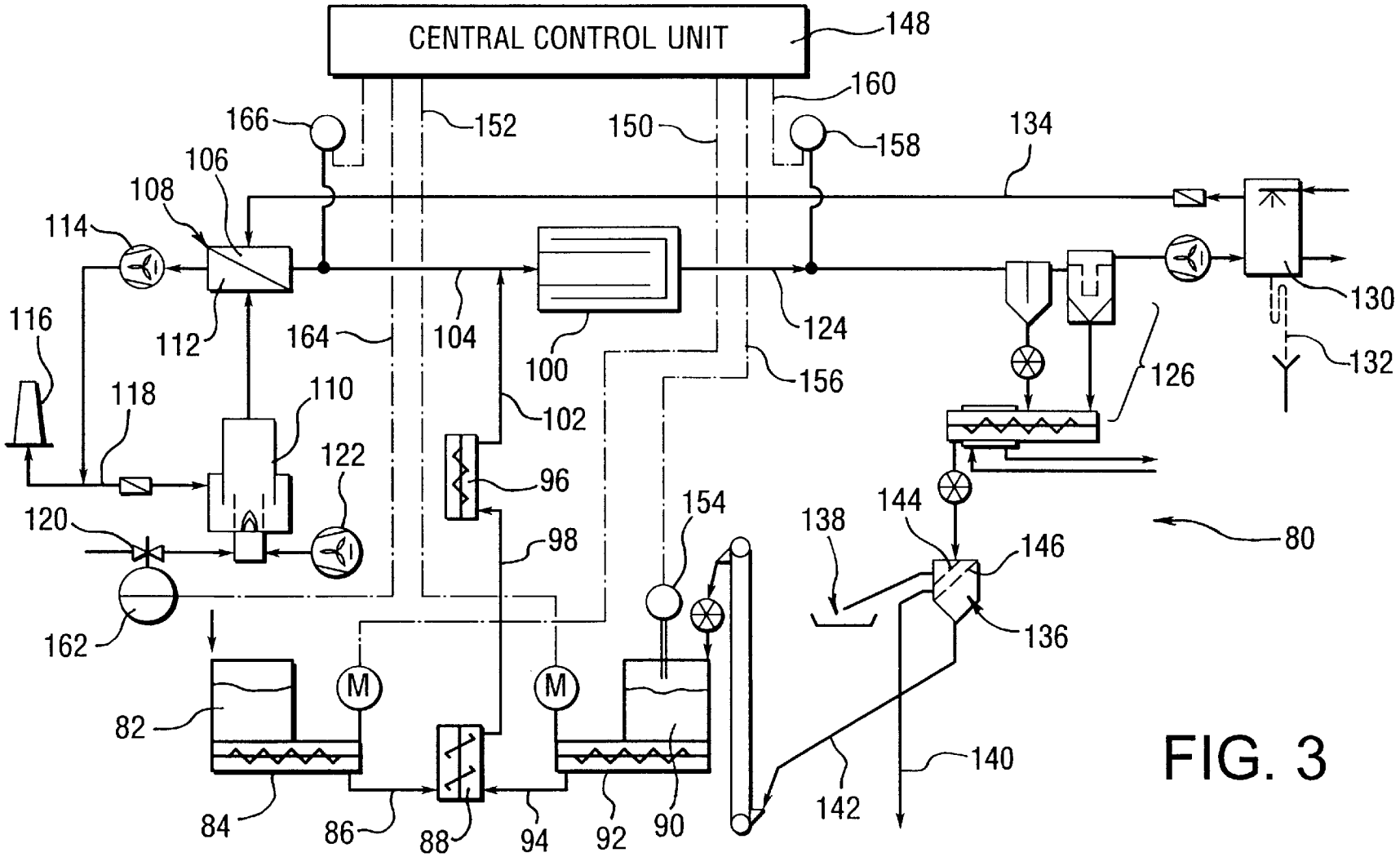
FIG. 3 is a schematic diagram of a drying plant in accordance with a preferred embodiment of the invention.

Referring to FIG. 3, a preferred embodiment of the process and apparatus of the invention is illustrated. As shown, the overall drying apparatus 80 is similar to the apparatus of FIG. 1, except for the omission of the roller mill for crushing dried oversized particles. The invention therefore eliminates an expensive and high maintenance roller mill typical of conventional drying processes and apparatus. Referring to FIG. 3, fresh wet material is received and stored in a storage silo 82 and then conveyed by a screw feeder 84 through a line 86 to a mixer 88. Previously dried material having a specific particle size is received and stored in a silo 90 having a screw feeder 92 for feeding the dried material through a line 94 to the mixer 88. The fresh wet material and previously dried material are mixed in the mixer 88 and carried to a screw conveyor 96 through line 98 for conveying the mixture to a drier 100 through line 102. In the embodiment illustrated, the drier 100 is a rotary drum drier as known in the art. The drier can be, for example, the drier disclosed in U.S. Pat. No. 5,309,849 to Krebs, which is hereby incorporated by reference in its entirety. In alternative embodiments, the drier can be a fluidized bed or disc drier as conventionally known. Hot air is fed through a line 104 from the secondary side 106 of a heat exchanger 108 where the air is heated. A furnace or boiler 110, such as a gas or oil fired boiler, produces hot air which is fed to the primary side 112 of the heat exchanger 108 for heating the drying gas. The exhaust gas from the heat exchanger 108 is conveyed by a fan 114 to an exhaust chimney 116 or recycled through a separate line 118 to the furnace 110. Fuel is fed to the furnace 110 through a control valve 120 which adjusts the amount of fuel fed to the furnace 110. Combustion air is also fed to the furnace through a fan 122 in a conventional manner.

The hot drying gas and the mixture of wet material and previously dried material are passed through the drier 100 and exit through a line 124 to a filter assembly 126. The filter assembly separates the drying gas from the dried solid material and carries the separated gases by a fan 128 through a condenser 130. A suitable filter assembly is disclosed in U.S. Pat. No. 5,309,849 and U.S. Pat. No. 5,318,184 to Krebs, which are hereby incorporated by reference in their entirety. Water vapor and other vapors are removed from the gas in the condenser and discarded appropriately through line 132. The drying air is then returned through a return line 134 to the secondary side 106 of the heat exchanger 112 for reheating and feeding to the drier 100.

The filter assembly 126 then conveys the separated dried material to a filter screen assembly 136. The filter assembly 136 is a standard assembly as known in the art. The filter screen assembly 136 separates large particles or granules with a first screen 144 and delivers the large granules to a suitable storage vessel 138. The filter screen assembly 136 further separates a middle size particle fraction by a second screen 146 and discards the middle size particles through a line 140 to a suitable storage facility. The small size particles are passed through the filter screen 136 and conveyed through a line 142 to the second silo 90 without crushing or processing where they are stored and eventually fed for mixing with fresh wet material. The small size particles are generally less than about 1.5 mm and preferably less then about 0.8 mm.

A central control unit 148 is connected by lines 150 and 152 to the feed conveyers 84 and 92 for the fresh wet material and the previously dried material for controlling the amount of each material fed to the mixer 88. By controlling the ratio and the amount of each material fed to the mixer 88, the degree of dryness of the mixture fed to the drier can be controlled. Controlling the degree of dryness of material fed to the drier 100 determines the average particle size of the dried material exiting the drier and the amount of small particle size material obtained from the drier 100. By controlling the amount of the small particle size dried material obtained form the drier 100, the amount of small particle size material available in the second silo 90 for mixing with fresh dried material can be controlled and maintained at a desirable level.

The second storage silo 90 includes a material level detecting device 154 operatively connected to the central control unit 148 by line 156. The level detecting device 154 is able to monitor the amount of material in the second silo 90 and to detect when the level of material falls below a predetermined level or rises above a predetermined level. The level detecting device 154 is able to measure the volume and/or weight of the material contained in the silo 90. The level detecting device 154 can be any suitable device known in the art capable of monitoring and detecting the level of dried material in the silo 90 either continuously or at predetermined time intervals.

The level control device 154 sends a signal through the connection 156 to the central control unit 148 indicating changes in the level of fine or small grain material in the silo 90. The central control unit 148 then sends a control signal to the screw feeder 92 of the second silo 90 through line 152 to adjust the amount of previously dried material fed to the mixer 80. For example, if the level of the previously dried material in the second silo 90 falls below a predetermined level which indicates a drop in the amount of small particle size material obtained from the dried material exiting the drier 100, the central control unit 148 adjusts the screw conveyor motor of screw feeder 92 to increase the quantity of previously dried material being fed to the mixer 88. This increases the amount of previously dried material in the mixture, thereby increasing the dryness of the mixture being fed to the drier 100. As indicated in FIG. 2, as the degree of dryness of the feed material to the drier increases, the amount of small particle size material obtained from the drier 100 increases without changing the operating temperature of the drier. This results in an increased amount of small particle size material fed to the second silo 90 which is then detected by the level detector 154 which sends a signal to the central control unit 148 to adjust the screw feeder accordingly.

In further embodiments, the central control unit 148 can send a signal through a line 150 to the screw feeder 84 of the first silo 82 to control the amount of wet material fed to the mixer 88. This can be done independently of the control signal for controlling the screw feeder 92 of the second silo 90 or simultaneously and in cooperation with the adjustment of the feed of dried material. A control signal from the level probe 154 in the second silo 90 indicating a decrease in the level of small particle size previously dried material in the second silo 90 results in the central control unit reducing the speed of the screw conveyor 84 of the first silo 82 for reducing the amount of wet material fed to the mixer 88. This reduces the degree of dryness of the resulting mixture being fed to the drier 100, thereby increasing the degree of dryness of the material exiting the 100 and resulting in an increase in the proportion of small particle size material in the dried material exiting the 100. When the central control unit 148 adjusts the speed of the screw feeders 84 and 92 from the first silo 82 or the second silo 90, the level of material in the second storage silo 90 continues to drop for a period of time. However, as the degree of dryness of the material exiting the drier 100 increases and produces a larger proportion of small particle size material, the level in the second silo 90 increases accordingly, and the level detector 154 in the second silo 90 measures in the increase in the level of the small particle size material and signals the control unit 148 to reduce the feed rate and the amount of small particle size material being fed to the mixer 88. In this manner, the feed rate of the previously dried material fed to the mixer 88 is adjusted inversely proportional to the amount of small particle size material obtained in the resulting dried material exiting the drier 100. Thus, as the amount of small particle size material in the resulting dried material decreases, the amount of previously dried material fed to the mixer 88 is increased.

When the level of the small particle size material in the second silo 90 rises above a predetermined level, the central control unit 148 adjusts the screw feeder 92 to reduce the amount of material fed to the mixer 88, thereby producing a mixture having an increased proportion of wet material being fed to the drier 100. Alternatively, the central control unit 148 can adjust the feed rate of the screw feeder 84 from the wet material to increase the amount of wet material fed to the mixer 88 to increase the amount of wet material in the resulting mixture. The increase in the amount of wet material in the mixture being fed to the drier 100 produces a dried material having a lower degree of dryness and, thus, a decreased amount of small particle size material. When the amount of small particle size material in the second silo 90 decreases to a predetermined level, the central control unit 148 adjusts the screw feeders 92 and 84 to maintain a constant level of small particle size material in the dried material.

This control process and apparatus are implemented so long as the amount of small particle size material collected from the drier 100 remains within certain predetermined limits which are measured by the level indicator 154 in the second storage silo 90. In order to counteract the excessive changes in the amount of small particle size material produced for feeding to the mixture, an additional control loop for monitoring the temperature of the material exiting the drier 100 is provided for regulating the dryness of the material exiting the drier.

A temperature sensor 158 is provided in the pipe 124 exiting the drier 100 for measuring the exit temperature of the drying air and the solid material. As long as the level of the small particle size material in the second silo 90 is maintained between a minimum and maximum predetermined level, the exit drying temperature is maintained at a constant level. In examples of the invention, the exit drying temperature is maintained about 90° C. When the level of small particle size material measured in the second silo 90 drops below a predetermined level, the central control unit 148 increases the output of the furnace 110 to increase the temperature of the drying air fed to the drier 100 which results in an increased dryness of the material and, thus, a high percentage of small particle material exiting the drier 100. The temperature sensor 158 in the outlet of the drier 100 is coupled to the central control unit 148 by line 160 for sending a signal indicating the temperature of the material exiting the drier. The central control unit 148 is also coupled to the control valve 120 by a control device 162 through line 164 of the furnace 110 for adjusting the amount of fuel and/or air to the furnace 110 which controls the temperature of the air passing through the primary side 112 of the heat exchanger 108. As the temperature of the drying air in line 104 increases, the average particle size of the material exiting the drier 100 decreases and the amount of small particle size material increases.

In a similar manner, when the level of small particle size material in the second silo 90 increases above a predetermined level, the central control unit 148 reduces the operating temperature of the furnace 110 to reduce the temperature of the drying air fed to the drier 100. Reducing the inlet temperature of the drying air reduces the degree of dryness of the material exiting the drier 100 and reduces the amount of small particle size material obtained. In further embodiments, a temperature sensor 166 can be provided in the line 104 between the heat exchanger 108 and the drier 100 for measuring the temperature of the drying air exiting the heat exchanger 108 before entering the drier 100. The temperature sensor 166 is also coupled to the central control unit 148. In this manner, the central control unit 148 can adjust the furnace 110 to produce a desired temperature of the drying air entering the drier 100.

The process and apparatus of the invention controls the amount of small particle size material obtained from the drier and reduces the amount of the large oversized particles normally obtained in this type of drying process. The oversized particles which are produced are separated from the filter screen assembly 136 and collected for disposal. In further embodiments, the process and apparatus can be used, for example, in a fluidized bed drying plant which uses the small particle size dried material as a fuel. The process of the invention eliminates the roller mill downstream of the screen typical of the previous fluidized bed drying plants. Thus, the process can be implemented in plants which are run with less machinery and require less maintenance.

The central control unit 148 is selected according to the particular requirements of the process and apparatus. For example, the central control unit can be a microprocessor with a program that represents the control relationship between the level of material in the silo 90, the rate of feed of the wet material and previously dried material, and the inlet and outlet temperatures from the drier 100. The feed rates of the wet and previously dried material are adjusted in response to the exit temperature to maintain a constant desired exit temperature. The central control unit 148 includes suitable hardware as known in the art and operating software capable of carrying out the desired functions. Alternatively, the central control unit 148 can be a permanently wired circuit. In addition, the programming of the central control unit 148 includes suitable inquiry loops for all measuring devices relevant to the control process. In still further embodiments, suitable display devices can be provided and the appropriate adjustments to the screw feeders and furnace temperature can be made manually by setting the burner temperature and/or setting the motor speeds of the screw conveyors or other conveying equipment.

While advantageous embodiments have been selected to illustrate the invention, it will be readily understood by those skilled in the art that various modifications and alternations can be made therein without departing from the spirit and scope of the invention as defined in the appended claims.

What is claimed is:

1. A process for drying a solid-liquid mixture comprising the steps of:

forming a mixture of a wet material and a previously dried granular material having a predetermined particle size;

passing said mixture through a drying device to produce a dried product containing a first granular fraction of said granular material, and a second fraction having a particle size greater than said first fraction;

transferring said first fraction to a storage device and measuring the volume of said first fraction in said storage device produced in said drying step; and adjusting the amount of said previously dried material mixed with said wet material in relation to the volume of said first fraction obtained from said drying step to produce a predetermined quantity of said first fraction in said drying step.

2. The process of claim 1, comprising adjusting the amount of said previously dried granular material mixed with said wet material at a rate inversely proportional to the amount of said first fraction produced in said drying step.

3. The process of claim 1, further comprising feeding said previously dried material for mixing with said wet material from said storage device.

4. The process of claim 1, comprising measuring the amount of said first fraction in said storage device produced in said drying step at predetermined time intervals, and adjusting the amount of said previously dried material mixed with said wet material at said predetermined intervals.

5. The process of claim 1, comprising continuously measuring the amount of said first fraction in said storage device produced in said drying step, and continuously adjusting the amount of said previously dried material mixed with said wet material.

6. The process of claim 1, further comprising measuring an exit temperature from said drying device, and adjusting the amount of said previously dried material mixed to said wet material in relation to said exit temperature.

7. The process of claim 6, comprising the steps of detecting an exit temperature from said drying device above a predetermined level, and reducing the amount of said previously dried material mixed with said wet material.

8. The process of claim 1, further comprising the steps of measuring the amount of said mixture passing through said drying device, measuring an exit temperature from said drying device, and adjusting the amount of said mixture fed to said drying device to maintain said exit temperature at a predetermined level.

9. The process of claim 1, further comprising the steps of measuring an exit temperature from said drying device, and adjusting a feed temperature to said drying device in response to the amount of said first fraction produced in said drying step.

10. The process of claim 9, further comprising adjusting said feed temperature to said drying device inversely proportional to the amount of said first fraction produced in said drying step.

11. The process of claim 1, wherein said wet material is sewage sludge.

12. A process of drying a wet material comprising the steps of:

feeding a wet material to a mixer at a first rate;

feeding a previously dried material having a first particle size to said mixer at a second rate and mixing with said wet material to form a mixture;

drying said mixture in a drier to produce a dried material containing a mixture of said first particle size material and a dried material having a second particle size larger than said first particle size;

separating said material of said first particle size from said dried mixture and conveying said material of first particle size to a storage device, and measuring the amount of said material in said storage device;

recycling said material of first particle size in said storage device to said mixer for mixing with said wet material; and adjusting said second feed rate of said previously dried material to said mixer in response to said measured amount of dried material in said storage device.

13. The process of claim 12, further comprising the step of adjusting said second feed rate of said previously dried material to be mixed with said wet material inversely proportional to the amount of said material of said first particle size produced in said drying step and in said storage device.

14. The process of claim 12, further comprising the steps of measuring the amount of said dried material of first particle size in said storage device produced in said drying step at predetermined time intervals, and adjusting said second feed rate of said previously dried material mixed with said wet material at said predetermined intervals.

15. The process of claim 12, further comprising the steps of continuously measuring the amount of said dried material of said first particle size in said storage device produced in said drying step, and continuously adjusting said second feed rate of said previously dried material mixed with said wet material.

16. The process of claim 12, further comprising the steps of measuring an exit temperature of said material from said drier, and adjusting said second feed rate of said previously dried material mixed with said wet material in relation to said exit temperature to obtain a desired exit temperature.

17. The process of claim 16, further comprising the steps of measuring an exit temperature from said drier above a predetermined level, and reducing said second feed rate of said previously dried material mixed with said wet material to obtain a predetermined exit temperature.

18. The process of claim 12, further comprising the steps of measuring said first and second feed rates, measuring a material exit temperature from said drier, and adjusting said first and second feed rates to maintain an exit temperature at a predetermined level.

19. The process of claim 12, further comprising measuring an exit temperature from said drier, and adjusting a feed temperature to said drier in response to said amount of said material of first particle size in said storage device produced in said drying step to obtain a predetermined exit temperature from said drier.

20. The process of claim 19, comprising adjusting a feed temperature to said drier inversely proportional to said amount of said material of first particle size in said storage device produced in said drying step.

21. The process of claim 12, wherein said wet material is sewage sludge.

22. A drying apparatus for drying a wet material comprising:

a mixer for mixing a wet material and previously dried material;

a first feeder for feeding a wet material to said mixer at a first feed rate;

a second feeder for feeding a dried material of a first particle size to said mixer at a second feed rate;

a drier for drying said mixture of wet and previously dried material to produce a mixture of dried material of said first particle size and a dried material having a second particle size greater than said first particle size;

a storage device for receiving said dried material of said first particle size, said storage device including a level sensing device for measuring the level of material therein;

a conveyor for conveying said dried material of said first particle size in said storage device to said second feeder; and a control device operatively connected to said first and second feeders and to said level sensing device for adjusting the second feed rate of said second feeder in response to a level of dried material in said storage device.

23. The drying apparatus of claim 22, wherein said control device includes means for adjusting the second feed rate of said previously dried material to be mixed with said wet material inversely proportional to a measured level of said material of first particle size in said storage device produced in said drier.

24. The drying apparatus of claim 22, wherein said level sensing device includes means for measuring the level of said material of first particle size in said storage device produced in said drier at predetermined time intervals, and said control device includes means for adjusting the second feed rate of said previously dried material mixed with said wet material at said predetermined intervals.

25. The drying apparatus of claim 22, wherein said level sensing device includes means for continuously measuring the amount of said material of first particle size in said storage device produced in said drier, and said control device continuously adjusting the second feed rate of said previously dried material mixed with said wet material.

26. The drying apparatus of claim 22, further comprising a temperature sensor for measuring an exit temperature from said drier, and said control device including means for adjusting the second feed rate of said previously dried material mixed with said wet material in relation to said exit temperature.

27. The drying apparatus of claim 26, wherein said temperature sensor detects an exit temperature above a predetermined level, and said control device includes means for reducing the second feed rate of said previously dried material mixed with said wet material.

28. The drying apparatus of claim 22, comprising a temperature sensor for measuring an exit temperature from said drier, and said control device including means for adjusting the first and second feed rates and a feed rate of said mixture fed to said drier to maintain said exit temperature at a predetermined level.

29. The drying apparatus of claim 22, comprising a temperature sensor for measuring an exit temperature from said drier, and said control device including means for adjusting the exit temperature in response to the amount of said material of said first particle size produced in said drier.

30. The drying apparatus of claim 29, wherein said control device includes means for adjusting the exit temperature from said drier inversely proportional to the amount of said material first particle size produced in said drier.

31. The drying apparatus of claim 29, wherein said means for adjusting said exit temperature includes means for adjusting an inlet temperature to said drier.

32. The drying apparatus of claim 29, wherein said means for said exit temperature from said drier includes means for adjusting said first and second feed rates to said drier.

33. The drying apparatus of claim 29, wherein said means for adjusting said exit temperature from said drier includes means for adjusting the ratio of said wet material and said previously dried material to said mixer.

34. The drying apparatus of claim 22, further comprising a separator for separating and recovering said material having said first particle size from said dried mixture.

* * * * *